United States Patent [19]

Mitter

[11] Patent Number: 4,512,772

[45] Date of Patent: Apr. 23, 1985

[54] METHOD OF APPLYING FOAMED DYELIQUORS TO FIBROUS SUBSTRATES OR THE LIKE

[76] Inventor: Mathias Mitter, Falkenstr. 57, D-4815 Schloss Holte, Fed. Rep. of Germany

[21] Appl. No.: 450,109

[22] Filed: Dec. 15, 1982

[30] Foreign Application Priority Data

Dec. 23, 1981 [DE] Fed. Rep. of Germany ..... 3150937
Dec. 23, 1981 [DE] Fed. Rep. of Germany ..... 3150939

[51] Int. Cl.[3] ..... D06B 11/00; D06B 19/00

[52] U.S. Cl. ..... 8/477; 8/478; 8/151; 8/929

[58] Field of Search ..... 8/477, 478

[56] References Cited

U.S. PATENT DOCUMENTS 3,155,540 11/1964 Loeffler et al. ..... 118/314
3,990,840 11/1976 von der Eltz et al. ..... 8/477
4,061,001 12/1977 von der Eltz et al. ..... 8/477
4,297,860 11/1981 Pacifici et al. ..... 68/200
4,384,867 5/1983 Gruber ..... 8/477

FOREIGN PATENT DOCUMENTS 57830 8/1982 European Pat. Off. .
82465 6/1983 European Pat. Off. .
2402342 7/1975 Fed. Rep. of Germany .
3112161 10/1982 Fed. Rep. of Germany .
1515403 6/1978 United Kingdom .
1516882 7/1978 United Kingdom .

*Primary Examiner*—A. Lionel Clingman
*Attorney, Agent, or Firm*—Peter K. Kontler

[57] ABSTRACT

Two or more liquid treating agents which are to be applied to a stationary or running substrate are formed ahead of a collecting unit which thereupon admits a foamed compound composition into the applicator wherein the composition passes through the interstices of a screen so that it is reconverted into a liquid prior to contacting the substrate. The collecting unit can comprise or may be followed by a mixer, depending upon whether or not the constituents of the compound composition are to be converted into a homogeneous foam. The collecting unit receives discrete streams of foamed treating compositions, e.g., in the primary colors, from discrete foam generators each of which is followed by a storing device and by a regulating device, such as a valve which is adjustable by hand and/or by a computer. The valves can regulate the rate of flow of foamed treating compositions from the respective storing devices to the collecting unit as well as the rate at which the respective foam generators admit foamed treating compositions to the associated storing devices.

13 Claims, 2 Drawing Figures

METHOD OF APPLYING FOAMED DYELIQUORS TO FIBROUS SUBSTRATES OR THE LIKE

BACKGROUND OF THE INVENTION

The present invention relates to a method of applying dyeliquor or other treating compositions to stationary or running substrates of fibrous material or the like, such as continuous webs or discrete sections or panels of carpeting, paper, cords, strips, filaments and the like. More particularly, the invention relates to improvements in a method of applying foamed treating compositions to substrates through the interstices of a screen.

German Offenlegungsschrift No. 25 23 062 discloses an apparatus which can be utilizied for the application of a foamed treating composition to a stationary or moving substrate. The apparatus of this German publication embodies a foam generator and further includes means for applying a single type of foamed treating composition directly to the substrate. A drawback of such apparatus is its lack of versatility, due in part to the provision of a single foam generator, and its inability to provide the substrate with a predictable coating of treating composition. Direct application of a foam onto a stationary or running substrate presents many serious problems and is highly unlikely to result in uniform application of the foamed treating composition.

German Pat. No. 20 26 492 discloses the application of a liquid treating composition to a substrate through the interstices of a screen. This prior publication does not contain any suggestion to employ a foamed treating composition which exhibits a number of important advantages, especially during transport from the foam generator all the way to or into immediate or close proximity of the locus of application to the substrate.

German Auslegeschrift No. 22 14 377 discloses an apparatus which can be used to apply two or more miscible or unmiscible foamed treating compositions to a substrate so as to provide the latter with a multicolored pattern. The application of foamed compositions takes place directly onto the substrate with the aforediscussed drawbacks as concerns the uniformity and/or predictability of distribution of the treating composition.

It has been found that none of the aforediscussed prior proposals satisfy strict requirements regarding the reproducibility and accuracy of the application of dyeliquors and/or other treating compositions to stationary or running substrates, for example, to the naps of carpets, in such a way that the base layer of the treated material is not soaked with the liquid but that the entire nap is properly dyed all the way to its very roots. Moreover, the aforediscussed conventional apparatus are incapable of predictably applying two or more different dyes at a single dye-applying station and with a single applicator. Still further, heretofore known apparatus and methods do not allow for a wide selection of various treating compositions and/or patterns to be applied to the substrate. Reproducibility of the application of two or more different treating compositions or two or more different shades of a given treating composition is important not only when the substrate is in motion but perhaps even more when the application of treating compositions takes place in successive stages with an interruption for shifting of the substrate between successive stages. Last but not least, heretofore known proposals do not allow for rapid and inexpensive conversion or shifting from operation in accordance with a predetermined pattern to rapport-free application of dyes to successive unit lengths or areas of a substrate or vice versa.

Attempts to overcome the aforediscussed drawbacks of heretofore known apparatus for the application of one or more treating compositions to moving or stationary substrates include resort to an entirely different mode of operation, namely, the utilization of a large number of nozzles which are actuated to spray different types of liquid treating compositions (e.g., differently colored dyes) onto the nap of a carpet or the like. It has been found that such proposals also fail to meet exacting requirements concerning the accuracy and reproducibility of the patterns (and especially the establishment of clear boundaries between differently colored sections of the patterns), even of the nozzles are caused to discharge sprays of treating composition at a time when their orifices are held in immediate proximity of the substrate. This is due to the fact that the sprays which issue from such orifices cannot be controlled and adjusted with a very high or highest degree of accuracy. Moreover, the sprays are likely to soak the substrate, i.e., to moisten not only the parts (such as the nap of a carpet) which are to be dyed but also those parts which should not be contacted by the treating composition at all. This is due to the fact that the rate of discharge of atomized liquid at the center of the cone which issues from the orifice of a nozzle is higher than the rate of discharge along the marginal portions of the cone; therefore, and if the marginal portions of the cone should supply atomized liquid treating composition at a rather pronounced rate, the admission of liquid in the central region of the cone is invariably excessive.

The presently known teachniques of applying one or more treating compositions to the nap of a carpet or the like exhibit many additional drawbacks. Thus, a pattern of certain size normally repeats itself all over along the length of the substrate, and the size of each such pattern is invariably the same. This can present problems and can entail waste in the material of the carpet when the latter is to be laid and the area to be covered is such that it is necessary to resort to a patchwork of two or more pieces of carpeting. Care should be taken to avoid the presence of clear-cut boundaries between the neighboring pieces. As mentioned above, heretofore known proposals fail to provide an acceptable solution of such problems.

An additional problem which cannot be overcome by resort to presently known methods and apparatus is that they do not allow to maintain a specific color unchanged for the application of a long piece of substrate. The sections which are dyed with successively mixed or otherwise formed treating compositions exhibit different shades, tones or other color qualities and the differences in shading can be quite pronounced so that it is not possible to match two pieces which have been dyed during different stages of the coloring operation.

OBJECTS AND SUMMARY OF THE INVENTION

An object of the invention is to provide a novel and improved method of applying dyeliquors or analogous treating compositions to stationary or mobile substrates in such a way that the finished product exhibits a much higher degree of uniformity and its characteristics match or closely approximate the desirable optimum characteristics.

Another object of the invention is to provide a method of applying one or more treating compositions to a stationary or running substrate in such a way that the desired color shade or hue can remain unchanged for practically unlimited intervals of time.

A further object of the invention is to provide a method which can be resorted to for the application of liquid treating compositions to a wide variety of substrates and which renders it possible to treat, without interruptions, practically unlimited lengths of substrate in a continuous or intermittent operation.

An additional object of the invention is to provide a method which can utilize foamed treating compositions but avoids the drawbacks of heretofore known methods which are used for the application of foams to running substrates of textile or like material.

Another object of the invention is to provide a method which can be used with equal advantage for the application of one, two or more differently colored treating compositions in order to provide a substrate with a monochroic or with a multicolored pattern.

An additional object of the invention is to provide a method which renders it possible to provide a substrate with a multi-colored pattern with a single application of treating material at a single material-applying station.

Another object of the invention is to provide a method whose versatility greatly exceeds that of heretofore known methods and which can be used with equal advantage for the application of eye-pleasing repetitive or randomly formed patterns of treating composition in a single color, in two different colors or in three or more different colors.

The invention resides in the provision of a method of applying dyeliquor or another treating composition to a substrate, such as a textile or other fibrous material including paper sheets or webs, individual filaments, cords, strips, continuous carpets or carpets of unit length and/or others. The method comprises the steps of establishing and maintaining a plurality of differently colored supplies of foamed or frothed treating compositions, admitting predetermined quantities of the respective treating compositions from selected supplies to a collecting location (e.g., into a receptacle) which thereby accumulates a compound or composite composition, and feeding the compound composition toward the substrate including passing the compound composition through the interstices or openings of a screen (e.g., a rotary or stationary cylindrical or otherwise configurated stencil whose interstices are uniformly distributed throughout the entire stencil or form one or more predetermined patterns).

The admitting step can include continuously conveying foamed treating compositions from the selected supplies to the collecting location and converting the thus conveyed treating compositions into a monochroic compound composition not later than during passage of such composition through the interstices of the screen.

The supplies may furnish foamed treating compositions in a plurality of different colors, e.g., in the three basic or primary colors red, green and blue or in the primary colors red, yellow, blue and green.

The admitting step can comprise selecting the desired percentages of various treating compositions in the compound composition and adjusting the rate of admission of treating compositions from the respective supplies to the collecting location as a function of the selected percentages.

The compound composition can constitute a mixture of the treating compositions which are admitted from selected supplies, and the feeding step can further comprise advancing the mixture to the interstices of the screen so that the substrate is dyed in a plurality of colors.

The admitting step can comprise continuously or intermittently conveying at least one of the treating compositions from the respective supply to the collecting location. The admitting step can also comprise conveying the treating compositions from the selected supplies to the collecting location at least substantially at the rate at which the compound composition is fed from the collecting location to the interstices of the screen.

The method can further comprise the steps of subjecting the compound composition to a preliminary mixing action at the collecting location and subjecting the resulting preliminarily mixed compound composition to at least one additional mixing action intermediate the collecting location and the screen.

The method can further comprise the step of subjecting at least one of the treating compositions to an at least partial decomposing action not later than on admission of the one treating composition to the collecting location.

The compound composition can contain discrete treating compositions in the respective colors, and the feeding step can comprise conveying such discrete treating compositions from the collecting location to the screen.

The establishing and maintaining step can comprise contacting liquids (such as dyeliquors) with different reaction agents to thus form the respective treating compositions. At least one of the reaction agents can constitute a thickening agent, and the method can further comprise the step of initiating reactions involving recombinations of ions in the supplies (such reactions may be anionic or cationic reactions).

The establishing and maintaining step can comprise foaming liquids of different consistencies; e.g., such liquids can exhibit different viscosities or they may contain different thickening agents.

The admitting step can include supplying to the collecting location different quantities of selected foamed treating compositions per unit of time, i.e., supplying to the collecting location selected foamed treating compositions at different rates. If at least one of the treating compositions is capable of being fractionated, the method can further comprise the step of fractionating such one composition not later than on admission to the treating location.

The novel features which are considered as characteristic of the invention are set forth in particular in the appended claims. The improved method itself, however, together with additional features and advantages thereof, will be best understood upon perusal of the following detailed description of certain specific embodiments of various apparatus for the practice of the method with reference to the accompanying drawing.

DESCRIPTION OF THE PREFERRED EMBODIMENTS

Figure 1:
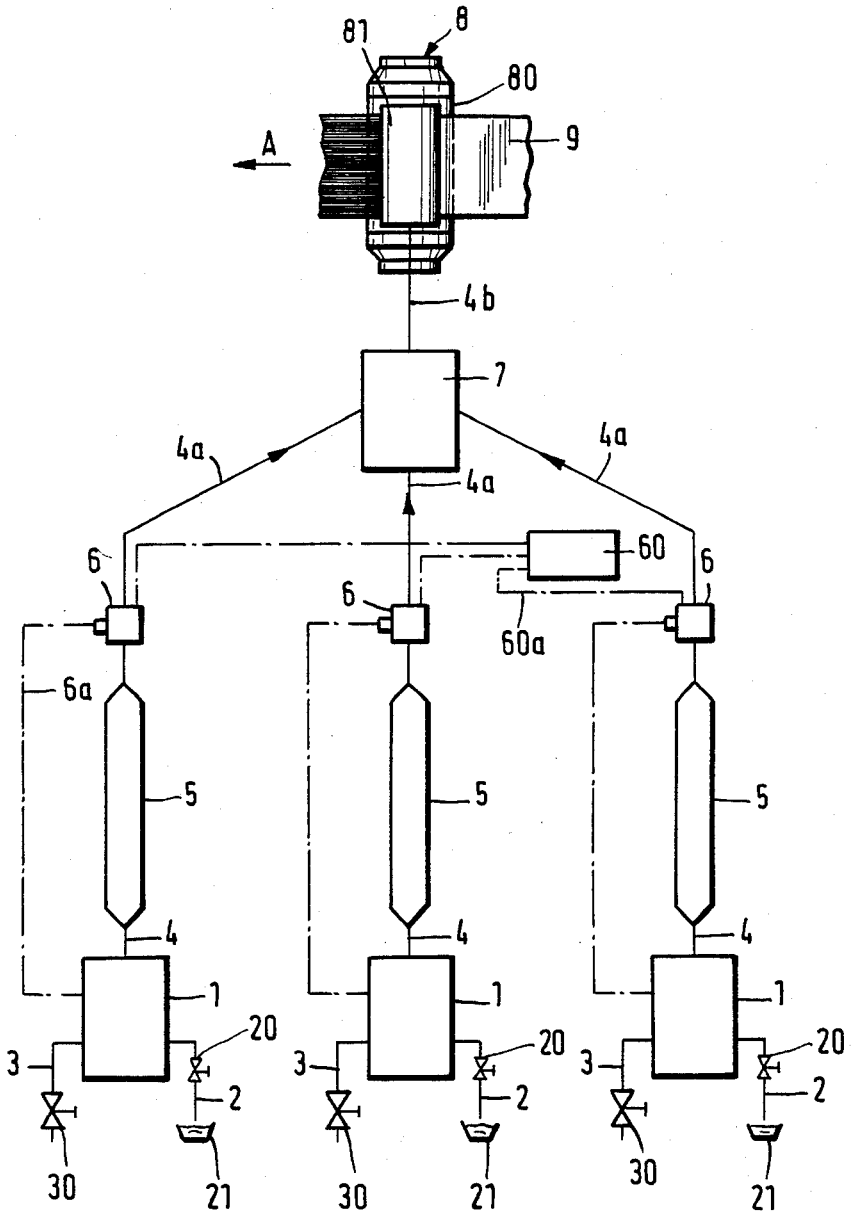
FIG. 1 is a schematic plan view of an apparatus which comprises three discrete foam generators as well as computer-controlled regulating means in the conduits between the foam generators and the collecting unit.

Referring first to FIG. 1, there is shown an apparatus which is constructed and assembled to apply several discrete treating compositions or a more or less intimate mixture of such compositions to a substrate 9 which is assumed to advance in the direction of arrow A. The apparatus comprises three discrete foam generators 1 each of which is equipped with its own source 21 of liquid, e.g., a dyeliquor in one of the three primary colors red, blue and green. The exact construction of the foam generators 1 forms no part of the present invention. For example, such foam generators may be constructed in a manner as disclosed in the commonly owned copending patent application Ser. No. 300,168 filed Sept. 8, 1981. Static foam generators are disclosed in German Offenlegungsschrift No. 25 23 062. Dynamic foam generators which can be used in the improved apparatus are disclosed, for example, in U.S. Pat. No. 4,193,762. As a rule, the liquid fraction of the foam will contain one or more tensides and the gaseous fluid is admitted at an elevated pressure (e.g., 2 bars) which is preferably adjustable. The two ingredients are brought into contact with one another in a mixing chamber of the foam generator. The mixing chamber can be designed in any one of a number of different ways. The disclosures of the just mentioned application and patents are incorporated herein by reference. The sources 21 are connected with the corresponding inlets of the foam generators 1 by conduits 2, and each such conduit contains a preferably adjustable flow regulating valve 20. Each of the foam generators 1 has a second inlet which is connected with a conduit 3 serving to supply a gaseous fluid and containing a preferably adjustable flow regulating valve 30. The foamed or frothed treating compositions which are discharged by the foam generators 1 via conduits 4 are collected in discrete storing devices 5. The portions **4*a* of the conduits 4 connect the respective storing devices 5 with a collecting unit 7, e.g., a vessel or receptacle which can confine a given quantity of foamed treating compositions and can be said to convert such treating compositions into a compound or composite composition ready to enter a path which is defined by a further conduit 4*b* and leads to the path for the running substrate 9. The purpose of the storing devices 5 is to ensure uniform delivery of foamed treating compositions to the respective inlets of the collecting unit 7**.

The portions **4*a* of the conduits 4 contain adjustable regulating devices 6 each of which can constitute or include an adjustable valve, an adjustable flow metering device or an adjustable flow measuring device of any known design. The arrangement is preferably such that the regulating devices 6 determine the rate of flow of foamed treating compositions from the respective storing devices 5 to the corresponding inlets of the collecting unit 7. In the embodiment of FIG. 1, the unit 7 constitutes or comprises a mixer which can intimately intermix the three treating compositions to form a monochroic compound composition flowing into and through the conduit 4*b* and toward the path of movement of the substrate 9. Such path is traversed by the screen 80 of an applicator unit 8 which further includes a suitable squeegee 81 (e.g., a slotted doctor or a roller) serving to expel the liquid fraction of the compound composition through the interstices of the screen 80 and into contact with the substrate 9. The screen 80 can constitute a cylindrical stencil with uniformly distributed interstices through which the liquid fraction of the compound composition passes on its way into contact with the substrate 9 whereby the latter is provided with a selected color as indicated to the left of the applicator unit 8 shown in FIG. 1. The conduit 4*b* of FIG. 1 can consist of discrete pipes or hoses each of which delivers a stream of foamed compound composition into the interior of the screen 80**.

If the substrate 9 is advanced in stepwise fashion, the rotary cylindrical screen 80 can be replaced with a plano screen of the type used in conventional screen printing machines and the squeegee is then movable back and forth to distribute the admitted compound composition over that portion of the substrate which is overlapped by such screen. Furthermore, and irrespective of whether it is rotary or stationary, the screen can be formed with interstices which together represent one or more predetermined patterns for the application of dyes to the substrate in a manner to form thereon images repeating themselves upon each revolution of the screen. The interstices of the screen 80 cause the compound composition to release bubbles of gaseous foaming agent so that the substrate is contacted (either exclusively or primarily) by the liquid fraction of the foamed compound composition which is fed into the path defined by the conduit(s) **4*b***.

As mentioned above, the screen 80 may constitute a cylinder or it can be replaced with a flat screen of the type used in conventional screen printing machines. It is further within the purview of the invention to replace a cylindrical screen with a screen in the form of an endless band which is trained over several pulleys or rolls, for example, in a manner as disclosed in German Pat. No. 22 58 892. The squeegee 81 may be of the type disclosed in German Offenlegungsschrift No. 20 35 220.

Each of the storing devices 5 can constitute a simple receptacle which is preferably configurated in such a way that it does not provide any dead corners for entrapment and longer-lasting retention of foamed treating composition supplied by the respective foam generator 1. The construction of the foam generators 1 forms no part of the invention; such foam generators are preferably adjustable so as to be capable of varying the ratio of gaseous fluid to liquid fraction of the respective foamed treating composition and/or of varying the rate of foam generation.

The regulating devices 6 may be analogous to those presently used to control and adjust the rate of flow of liquid treating compositions into the path of a running substrate. As a rule, such regulating devices should perform at least two functions, namely, (a) controlling the rate of admission of foamed treating compositions from the respective storing devices 5 to the corresponding inlets of the collecting unit 7 (i.e., imposing exact limits upon the quantities of treating compositions which reach the mixer of 7 per unit of time), and (b) regulating the operation of the associated foam generator 1 (namely, regulating the output of the foam generator by increasing or reducing the rate of admission of foam into the respective storing device). The ratio of gaseous fluid to the liquid fraction in the foamed treating compositions flowing from the foam generators 1 to the associated storing devices 5 can vary between 1:4 and 1:300. The errors in selection of the quantities of liquid fractions in the foamed treating compositions which enter the collecting unit 7 can be reduced by increasing the ratio of gaseous fluid in such treating compositions. For example, if the ratio of gas to liquid in the treating compositions flowing through the regulating devices 6 is 300:1, the likelihood of error in the rate of admission of liquid fractions (supplied by the respective sources 21) is reduced to 1/300 of the likelihood when a flow metering device monitors the flow of a liquid directly from a source to the locus of consumption or application.

The means for adjusting the regulating devices 6 comprises a computer 60 which is connected with the inputs of the corresponding regulating devices by electrical conductor means 60*a*. The reference characters 6*a* denote electrical connections between the regulating devices 6 and the associated foam generators 1. It will be noted that, in the embodiment of FIG. 1, each of the regulating devices 6 can be said to constitute an adjustable flow meter for the foamed treating composition which flows from the respective storing device 5 to the collecting unit 7, as well as a signal generator for the transmission of signals which control the operation of the associated foam generators 1.

If the three sources 21 respectively contain red, blue and yellow or green dyeliquors, the computer 60 can select the ratio of liquid fractions in the compound composition which is formed in the collecting unit 7 for admission into the conduit or conduits 4*b*. The compound composition exhibits a hue or shade which can be reproduced as often as desired in view of the fact that the computer 60 can reestablish the selected ratio of three different liquid fractions with a high degree of accuracy, and also because the regulating units 6 are capable of supplying accurately metered quantities of the respective dyeliquors to the mixer of the collecting unit 7.

If the substrate 9 is permeable to air, the application of liquefied compound composition (which has been relieved of the gaseous ingredient as a result of passage through the interstices of the screen 80) can be assisted by placing a suction box below the path of the substrate. Such suction box can be used in addition to or in lieu of the squeegee 81. The screen 80 can be rotated continuously or intermittently, at a constant speed or at a variable speed, depending on the mode of advancing the substrate 9 and/or on the desired effect which is produced by applied liquid fractions upon the coated side of the substrate. In other words, the substrate may be provided with a uniform (monochroic) coat of a coloring or other matter, it can be provided with a regular pattern of images or designs, or it can be provided with coating wherein the various dyes are in random distribution. The substrate may constitute a fabric (e.g., a length of carpeting) whose nap is to be dyed. Alternatively, the substrate may constitute a web of paper, a series of textile strands, strips, ropes, fibers, braids or a series of discrete panels or sheets of paper, carpeting or the like. The composition of the substrate can also vary within a wide range. For example, the apparatus can be used to apply dyeliquors to textile fibers, fleece, nonwoven materials, paper, synthetic plastic materials, foils and/or others.

The computer 60 can be programmed to select a desired ratio of various colors in the compound composition flowing into the conduit(s) 4*b*, and such programming can be varied from time to time, depending on the desired pattern or hue of liquid matter which is applied to the substrate. As mentioned above, the percentages of various liquors in the substance leaving the collecting unit 7 can be selected with a high degree of accuracy and reproducibility. It is also possible to shut off at least one of the regulating devices 6 and to deliver foamed treating composition only from the remaining storing device or devices 5. The number of foam generators 1, storing devices 5 and regulating devices 6 can be increased well beyond three. Also, the mixing action in the collecting unit 7 can be varied within a desired range, depending on the sought-after effect of the applied liquid fractions upon the appearance and/or quality of the finished product. It has been found that the improved apparatus is capable of selecting a desired pattern or hue with a degree of reproducibility which cannot be matched by heretofore known apparatus. This is achieved by resorting to several foam generators, to regulating devices which control the flow of foam from the foam generators to the collecting unit 7, by the provision of the collecting unit 7 which may but need not necessarily carry out a more or less pronounced mixing action, and by the provision of a screen which extends across the path of flow of compound composition from the unit 7 to the path for or locus of the substrate 9.

It has been found that the flow of foamed treating compositions to the collecting unit 7 and the flow of compound composition from the unit 7 to the applicator unit 8 can be enhanced by adjusting the foam generators 1 in such a way that the pressure in the storing devices 5 exceeds the pressure in the region of the applicator 8. This ensures a predictable and uniform rate of flow of foamed treating compositions to the unit 7 and of the compound composition from the unit 7 to the unit 8.

An advantage of the storing devices 5 is that they confine selected quantities of foamed treating compositions and thus ensure predictable delivery of such compositions to the collecting unit 7. It is difficult to operate the foam generators 1 intermittently because several minutes elapse before a freshly started foam generator begins to deliver foam of desired consistency. Were the storing devices 5 omitted and were the computer 5 programmed in such a way that one or more regulating devices 6 would interrupt the delivery of the respective foamed treating composition(s) for longer or shorter intervals of time, it would be necessary to repeatedly start and arrest the respective foam generator(s) with attendant drawbacks as concerns the quality of the foam which is generated immediately after starting a generator. The provision of storing devices 5 enables the foam generators 1 to operate continuously, even if the corresponding regulating devices 6 are set to effect intermittent admission of foamed treating compositions into the collecting unit 7. All that happens is that the pressure of confined foamed treating compositions in the storing devices 5 increases while the respective regulating devices 6 interrupt or reduce the rate of flow into the collecting unit 7. Even this can be avoided by appropriate regulation of the foam generators 1 via conductor means 6*a*.

In each instance, the improved apparatus ensures that the streams of foamed treating compositions do not mix with one another ahead of the collecting unit 7, i.e., ahead of that location where the merging of various streams into a single stream (which may but need not be homogenized) is desirable for the purpose of conveying the resulting compound composition into the applicator unit 8.

Figure 2:
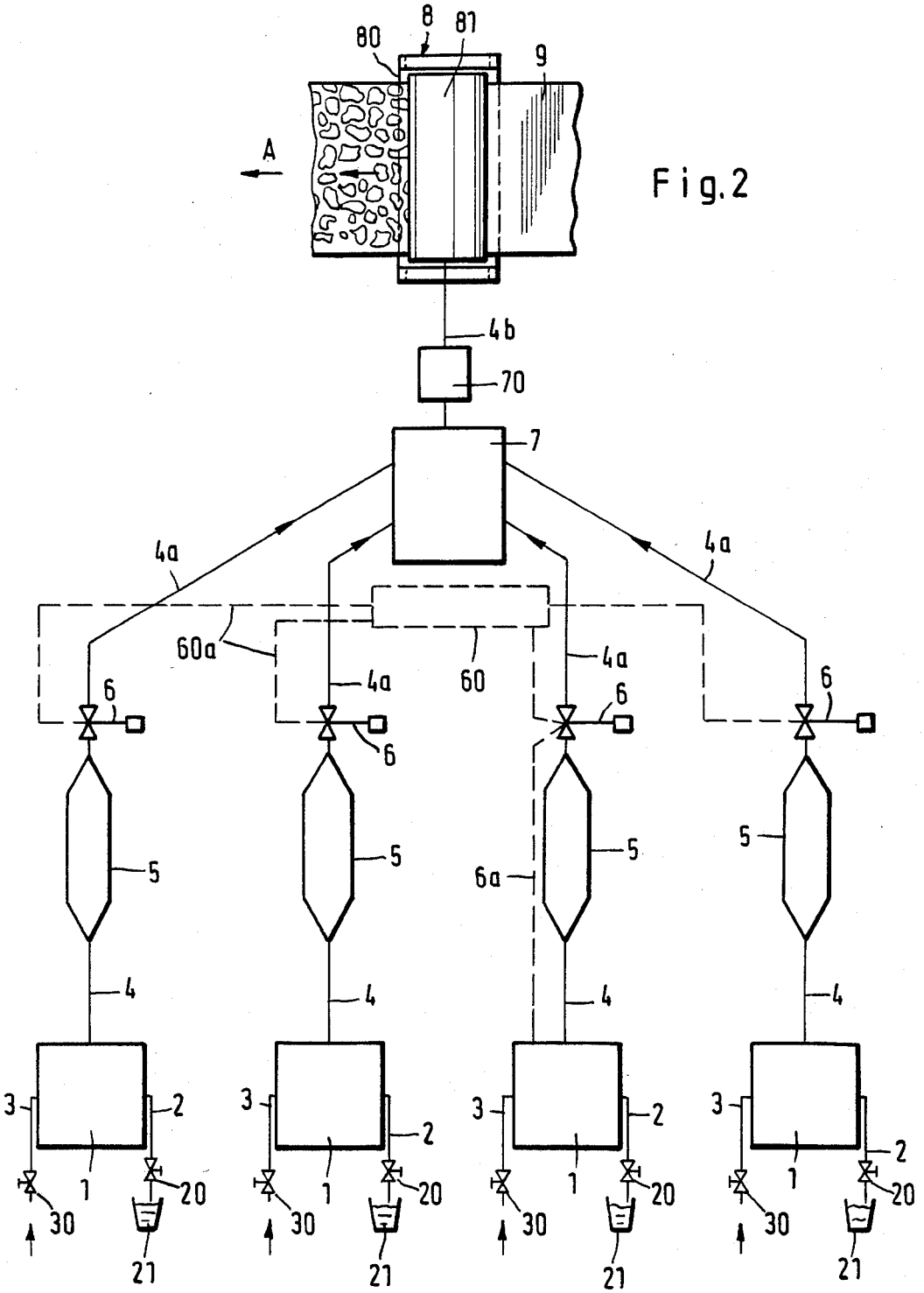
FIG. 2 is a similar schematic plan view of a modified apparatus with four discrete foam generators and manually or automatically adjustable regulating valves in the conduits between the storing devices for foamed treating compositions and the collecting unit.

FIG. 2 shows a modified apparatus wherein all such parts which are identical or are clearly analogous to corresponding parts of the first apparatus are denoted by similar reference characters. A feature of the apparatus of FIG. 2 is that it can provide the substrate 9 with a multicolored pattern which can be seen to the left of the screen 80 in the upper portion of FIG. 2. To this end, the interstices of the screen 80 are distributed and grouped in a manner to permit the passage of liquor into contact with selected portions of the upper side of the substrate 9 but to prevent the application of liquor to the remaining portions of such upper side.

The collecting unit 7 is devoid of any mixer or it may be equipped with (or it may constitute) a device for coarse (preliminary) intermixing of the admitted streams of foamed treating compositions. In either event, the treating compositions which are admitted into the collecting unit 7 of FIG. 2 remain distinct while in the interior of the vessel forming part of or constituting the unit 7. The latter can be termed a coarse or preliminary mixer and, in its simplest form, may constitute a housing or vessel of required size and shape so as to avoid long-lasting retention of batches of foamed treating compositions in dead corners or like configurations. Alternatively, the unit 7 can comprise or constitute a means wherein two or more admitted streams of foamed treating compositions are carefully intermixed, e.g., to form a streaked compound composition which then leaves the unit 7 via conduit or conduits **4*b***.

In the apparatus of FIG. 2, the conduit **4*b* contains a means 70 for influencing the compound composition which flows from the collecting unit 7 to the applicator unit 8. The influencing means 70 can include or constitute one or more slowly operating mixers so as to effect a somewhat more pronounced intermixing of two or more foamed treating compositions entering the collecting unit 7 via corresponding conduit portions 4*a* and thereupon flowing into and in the conduit 4*b***.

The apparatus of FIG. 2 comprises four discrete foam generators 1 and an equal number of foam storing devices 5, one in each of the conduits 4. Such storing devices are installed upstream of the respective regulating devices 6 each of which can constitute or include a manually or automatically adjustable valve. The arrangement may be such that each of the valves 6 is adjustable manually as well as by an automatic programmable adjusting means, e.g., a computer 60 which is indicated by broken lines. Alternatively, the computer 60 can influence only a limited number (e.g., one, two or three) of valves 6. The computer 60 can also influence the operation of the foam generators 1, either directly or through the medium of the associated regulating devices 6. This renders it possible to ensure that each of the foam generators 1 produces foamed treating composition at an optimum (e.g., average) rate for any desired interval of time. The computer 60 can open the valves 6 to a greater or lesser extent, or it can cause the valves to remain open for longer or shorter intervals of time prior to closing, again for selected intervals of time.

The construction of the applicator unit 8, which receives one or more streams of compound composition via conduit(s) **4*b*, can be identical with that of the similarly referenced unit in the apparatus of FIG. 1. The conduit 4*b*, as well as the conduits 4, 4*a*, may constitute or include flexible hoses or rigid pipes, depending on the pressures therein and the nature of treating compositions flowing therethrough. The substrate 9 is assumed to be advanced, either intermittently or continuously and at a constant or variable speed, in the direction of arrow A. The nature of the substrate 9** forms no part of the invention; as explained above, the substrate may be a running web or strip of textile material, paper, discrete cords, ropes, braids or analogous configurations consisting of textile filaments, paper, synthetic plastic material or a combination of these.

Each of the valves 20 and 30 shown in the lower part of FIG. 2 is preferably designed to allow for a practically infinite variation of the rate of admission of liquor and gaseous fluid to the respective foam generator 1. For example, the four foam generators 1 of FIG. 2 can supply streams of foamed treating compositions which respectively contain red, blue, green and yellow dyeliquors. Each of the four liquors can exhibit a different consistency, e.g., a different viscosity. Each conduit portion **4*a* delivers a single type of foamed treating composition to the respective inlet of the collecting unit 7, i.e., the separation of the four different foamed treating compositions in the foam generators 1, conduits 4, 4*a*, storing devices 5 and regulating devices 6 is absolute and the various treating compositions come into actual contact with one another only after they enter the unit 7. As mentioned above, the nature of the unit 7 may be such that the various treating compositions remain more or less clearly distinguishable in the conduit 4*b*, at least during flow between the unit 7 and the influencing means 70**.

By way of example, the first or leftmost regulating device 6 of FIG. 1 can be set to open and close at short intervals, the second regulating device 6 of FIG. 2 can be set to open and close at longer intervals, and the remaining two regulating devices 6 of FIG. 2 can be set by the computer 60 to open and close in accordance with a predetermined (irregular or regular) pattern. This ensures that the collecting unit 7 receives predetermined quantities of various foamed treating compositions per unit of time but that the rate of admission of such treating compositions varies within such unit of time. The exact hue or appearance of the compound composition leaving the unit 7 will depend on the presence or absence or mode of operation of a mixer in the unit 7. Thus, the apparatus of FIG. 2 can influence the pattern on the treated substrate 9 in a number of ways. The pattern is devoid of periodicity if the distribution of interstices in the screen 80 is uniform. However, such "random" pattern (i.e., a pattern which is devoid of periodicity) can be reproduced with a surprisingly high degree of accuracy. If the interstices of the screen 80 form a design, the patches of liquor which are applied to the substrate 9 can be repeated with an equally high degree of reproducibility.

If one of the regulating means 6 remains open for longer intervals of time or whenever the apparatus of FIG. 2 is in use, the substrate 9 can be provided with a pattern having a basic hue determined by the color of the foamed treating composition which is permitted to flow into the collecting unit 7 without interruptions. This is due to the presence of a relatively high percentage of the selected treating composition in the compound composition flowing into the conduit **4*b* and thence into the applicator unit 8**.

The nature of the pattern which is applied to the substrate 9 can be influenced in a number of ways including those outlined above plus several others. For example, by changing the rate of admission of compressed gaseous fluid via one or more conduits 3, one can influence the dimensions of gas bubbles in the foamed treating compositions flowing into the collecting unit 7. If the dimensions of the bubbles are increased, the compositions entering the unit 7 cannot be intermixed as thoroughly or intimately as if the admission of gaseous fluid (e.g., air) into the foam generators 1 were regulated with a view to form relatively small gas bubbles.

The characteristics of liquids in the sources 21 can vary within a wide range. This applies not only to the color of such liquids but also to their consistency as regards viscosity and/or other characteristics. For example, the characteristics of the liquids can be selected in such a way that the liquids are not likely to be intimately mixed in the interior of the collecting unit 7. Such reluctance to intimately mix with other liquids can be attributable to foaming in the respective foam generators 1 and/or to other influences. Each of the liquids can contain a different thickening agent, or two or more liquids can contain identical or analogous thickening agents. It is also within the purview of the invention to permeate various liquids with differently reacting agents or media (e.g., thickening agents) and to thereupon initiate (anionic or kationic) reactions involving recombinations of ions in the liquids or in the respective foamed treating compositions.

In one of its simpler forms, the collecting unit 7 can merely serve for gathering and further conveying of foamed treating compositions which are supplied thereto at identical or different rates (depending on the setting of the regulating devices 6). Alternatively, and as already mentioned above, the collecting unit 7 can serve for coarse or preliminary mixing of the admitted foamed treating compositions. This can be achieved by causing the inflowing foamed treating compositions to overcome various obstacles in the form of vanes, blades, wires, sieves or the like. Such obstacles can be stationary or they may constitute slowly turning rotors or other types of agitating devices.

The computer 60 can be replaced with a less sophisticated system which can adjust the regulating devices 6 in accordance with a preselected pattern. Also, the computer 60 can be disconnected from one or more regulating devices 6 so that the disconnected regulating devices can be adjusted by hand or by other programming means. One or more regulating devices 6 can be closed or otherwise deactivated for selected intervals or during a longer period of time. These and other features of the improved apparatus render it possible to gradually or abruptly change the hue of the treated portion of the substrate 9. For example, the apparatus can cause the applicator unit 8 to alternately apply brighter and darker patterns, depending on the desired effect of the dyeing operation. The ability of the apparatus to regulate the admission of foamed treating compositions into the collecting unit 7 in a number of different ways and within wide ranges enables the persons in charge to select a practically infinite number of hues and patterns such as, for example, by admitting short spurts of foamed treating composition from a first storing device 5, by admitting longer or larger batches of foamed treating composition from a second storing device, and by continuously admitting treating composition from the remaining storing device or devices. As a rule, the operator of the improved apparatus will provide the substrate with a coating which exhibits several shades or hues of a single color or two or more colors. Eye-pleasing monochroic effects can be produced by using liquids of the same color but by admixing different thickening agents to liquids entering different foam generators 1.

While the influencing means 70 can be of the type which ensures highly uniform intermixing of various treating compositions, it is often preferred to select an influencing means which merely effects a slight intensification of the mixing effect (if any) of the collecting unit 7 while ensuring that all of the different colors remain readily discernible in the compound composition flowing to the applicator unit 8. In other words, the conduit **4*b* need not deliver to the unit 8 a composition which is homogenous (insofar as its color is concerned); on the contrary, each of the various treating compositions which are admitted via conduit portions 4*a* can remain readily discernible in the material which flows in the conduit 4*b* and into the interior of the screen 80. The dimensions of batches of treating compositions in particular colors which flow in the conduit 4*b* can be determined in advance by adjustment of the regulating devices 6 and/or by the mixing action of the collecting unit 7 and/or influencing means 70**.

The improved method is susceptible of many additional modifications without departing from the spirit of the present invention. For example, the sources 21 can contain liquids other than dyeliquors; such other liquids can be applied for the purpose of enhancing the brilliancy of the substrate, they can constitute acids or other media which attack and thereby influence the appearance of the respective side of the substrate, they can constitute chemicals which promote the resistance of the substrate to penetration or adherence of dust or other contaminants, which enhance the stiffness or flexibility of the substrate and/or others.

The improved method exhibits a number of important advantages. For example, and as already indicated hereinbefore, the admission of metered quantities of two or more different liquid treating media to the collecting unit 7 can be regulated with a surprisingly high degree of accuracy by the simple expedient of foaming the liquid fractions prior to introduction into the unit 7. This will be readily appreciated by considering the following example: The foaming action in the foam generators 1 is assumed to be such that the ratio of gas to liquid in the streams of foamed treating compositions flowing into the respective storing devices 5 is 300:1. In other words, the volume of the liquid medium flowing from the respective foam generator 1 is three hundred times the volume of the liquid medium flowing from the respective source 21. Consequently, the measurement of the rate of flow of liquid medium in the conduit portion **4*a* is or can be several hundred times more accurate than if the measurement were carried out in the conduit 2 downstream of the respective source 21. The immediate result of accurate determination of the quantities of liquid treating media flowing into the collecting unit 7 is a more predictable application of liquids to the substrate 9** and the possibility of reconstructing a selected pattern as often and for as long as desired.

Another important advantage of the improved method is that the persons in charge can rapidly switch from the application of a multicolored pattern to the application of a monochroic pattern or vice versa, that it is possible to switch from the application of several discrete liquid media, which are not intermixed with one another on their way to the applicator unit 8, to the application of a more or less intimate mixture of such liquids, that the nature of the compound composition flowing in the conduit 4*b* can be varied while the apparatus is in use (e.g., to periodically change the brightness and/or other characteristics of the applied pattern), and that larger batches of liquids which are admitted via conduit portions 4*a* can be broken up into smaller batches (in the collecting unit 7 and/or in the influencing means 70).

A further important advantage of the improved method is that the substrate 9 need not be contacted by a foamed composition. This is desirable on the ground that the making of highly predictable designs is much simpler and is actually possible only if the foam is not allowed to come in direct contact with the substrate. For example, the improved method and apparatus render it possible to apply the pattern which is shown on the left-hand portion of the substrate 9 in FIG. 2 in such a way that each individual patch or fragment of the pattern exhibits a single color, two or more different colors, or two or more shades of one and the same color.

The conversion of foam into liquid by passing the foam through a screen prior to contact with the substrate is disclosed in the commonly owned copending patent application Ser. Nos. 325,058 and 325,059, both filed Nov. 25, 1981, or Ser. Nos. 300,170 and 300,171 both filed Sept. 8, 1981.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of applying dyeliquors to a moving substrate, comprising the steps of separately foaming differently colored dyeliquors; merging specific proportions of foamed dyeliquors at a collecting location; and applying the thus merged foamed dyeliquors to the substrate, including passing the foamed dyeliquors through the interstices of a screen.

2. The method of claim 1, wherein said merging step includes continuously conveying foamed dyeliquors to the collecting location and converting the thus conveyed foamed dyeliquors into an intimate mixture giving an intermediate color of uniform hue not later than during passage through the interstices of the screen.

3. The method of claim 1, wherein the dyeliquors include dyeliquors in three primary colors.

4. The method of claim 1, wherein said merging step includes leaving the different foamed dyeliquors unmixed to give a multicolored foam with its composition being altered in time with the proportions of different constituents being altered.

5. The method of claim 1, wherein said merging step includes continuously feeding at least one of the foamed dyeliquors to the collecting location.

6. The method of claim 1, wherein said merging step includes intermittently feeding at least one of the foamed dyeliquors to the collecting location.

7. The method of claim 1, wherein said merging step comprises feeding the foamed dyeliquors to the collecting location at least substantially at the rate at which the foamed dyeliquors are fed from the collecting location to the interstices of the screen.

8. The method of claim 1, further comprising the steps of mixing the foamed dyeliquors intermediate the collecting location and the screen.

9. The method of claim 1, further comprising the step of at least partly decomposing at least one of the foamed dyeliquors not later than on admission to the collecting location.

10. The method of claim 1, wherein the dyeliquors of different colors have different viscosities.

11. The method of claim 1, wherein the dyeliquors of different colors contain different thickening agents.

12. The method of claim 1, wherein said merging step includes supplying to the collecting location different quantities of selected foamed dyeliquors per unit of time.

13. The method of claim 1, wherein said merging step includes supplying to the collecting location selected foamed dyeliquors at different rates.

* * * * *